US005546698A

United States Patent [19]

Rock

[11] Patent Number: 5,546,698

[45] Date of Patent: Aug. 20, 1996

[54] SELF-ROTATING HANGING PLANT SUPPORT

[76] Inventor: Terry R. Rock, 2551 Paw Paw, Apt. 2B, Benton Harbor, Mich. 49022

[21] Appl. No.: 427,164

[22] Filed: Apr. 24, 1995

[51] Int. Cl.[6] ..... A01G 9/02; A47G 7/02

[52] U.S. Cl. ..... 47/67; 47/39

[58] Field of Search ..... 47/67 H, 67 R, 47/39 M; 248/324, 318

[56] References Cited

U.S. PATENT DOCUMENTS

| | | | |
|---|---|---|---|
| 4,216,619 | 8/1980 | Espy . | |
| 4,446,653 | 5/1984 | Morgan, Jr. . | |
| 4,574,521 | 3/1986 | Landy | 47/67 H |
| 4,873,790 | 10/1989 | Laterza | 47/67 H |
| 4,969,290 | 11/1990 | Skoretz | 47/39 M |
| 5,315,784 | 5/1994 | Henehan . | |

FOREIGN PATENT DOCUMENTS

| | | | |
|---|---|---|---|
| 2067837 | 7/1981 | United Kingdom | 47/39 M |

*Primary Examiner*—Terry Lee Melius
*Assistant Examiner*—Joanne C. Downs
*Attorney, Agent, or Firm*—David H. Baker; Rhodes & Ascolillo

[57] ABSTRACT

An apparatus for supporting and rotating a hanging plant, including a housing with an upper hook fixedly attached to a top surface thereon. A lower hook extends from a bottom surface of the housing, and is for hanging and supporting a plant thereon. There is a light sensing mechanism, disposed on the outside of the housing, for detecting the amount of ambient light incident upon the housing, along with a rotary mechanism, disposed within the housing, for periodically rotating the lower hook whenever the amount of ambient light detected by the light sensing mechanism exceeds a threshold value. The rotary mechanism further includes a DC motor stationed within the housing, a reduction gearing assembly connected to an output shaft of the motor, and a vertically disposed shaft, rotatingly coupled to the reduction gearing assembly and connected to the lower hook.

10 Claims, 5 Drawing Sheets

SELF-ROTATING HANGING PLANT SUPPORT

BACKGROUND OF THE INVENTION

1. Field of the Invention

The present invention relates generally to an apparatus for supporting and rotating a hanging plant and, more particularly, to an apparatus which rotates a hanging plant at specifically timed intervals during daylight conditions.

2. Description of the Related Art

U.S. Pat. No. 4,216,619 issued to C. Espy on Aug. 12, 1980 relates to a device for rotating a plant as moisture evaporates from the container holding the plant. Rotational motion on the plant is accomplished through the use of a spring which is linearly distorted by the weight of gravity. A spiral motion conversion mechanism connected to the spring converts the linear distortion into rotational motion.

U.S. Pat. No. 4,446,653 issued to R. Morgan, Jr. on May 8, 1984 also discloses a device for supporting and rotating a hanging plant which is responsive to the addition and evaporation of water in the plant holder. The device consists primarily of a cord attached to a fixed hook at one end, and a plant at the other end. The cord extends in length and winds in one direction in response to an increase in the weight of the plant due to the addition of water. Conversely, the cord retracts and winds in the opposite direction in response to a decrease in the weight of the plant due to the evaporation of the water.

U.S. Pat. No. 5,315,784 issued to W. Henehan on May 31, 1994 also relates to a device for rotating a hanging plant. Counteracting coaxial tension springs rotate the plant in one direction when the plant is watered and then back in the other direction as the water evaporated from the plant.

It is well recognized that a plant grows in the direction of sunlight and will eventually become lopsided if the plant is not rotated on a consistent basis. This is especially true in situations where the plant is hung adjacent a window, which provides sunlight from only one direction. While a plant can be permitted to grow evenly by manual rotation, this is often impractical as the plant owner can forget to rotate the plant at regular intervals. In addition, the manual rotation of a hanging plant can create an unnecessary risk of injury if the plant is located high enough where a stepladder is required to reach it. A need, therefore, exists for a device which will support an ordinary house plant while automatically rotating it at preselected intervals in order to promote even growth of the plant.

Apparatus such as those disclosed in the above identified patents all address, in various embodiments, ways of accomplishing the rotation of a hanging plant. In each case, the same principles of operation are employed; that is, the use of gravitational force on the plant, responsive to increases and decreases of the weight of the plant. These devices generally consist of springs or cords which, when extended or retracted, impart a rotational motion on the plant itself. It should be noted, however, that the amount of rotational motion on the plant ultimately depends on the amount of water present in the plant.

One disadvantage of the above mentioned approach is that different types plants of require differing amounts of water. Thus, for example, a 10 lb. plant which requires a minimal amount of water will rotate differently than a 5 lb. plant which requires a greater amount of water, using the type of apparatus as mentioned above. In addition, mechanical springs and cords are subjected to elastic stresses over time, and may be prone to wear out, thus reducing the sensitivity and overall effectiveness of the device.

SUMMARY OF THE INVENTION

Accordingly, it is a principal object of the present invention to provide a device which will automatically rotate a hanging plant at preselected intervals which are independent of the weight of the plant.

It is another object of the invention to provide such a device that effectively rotates varying sizes of plants.

It is a further object of the invention to provide such a device which is sensitive to the amount of ambient light present, beginning a rotation timing sequence only when a threshold value of ambient light is exceeded.

It is a further object of the invention to provide such a device which includes a mechanism for adjustably controlling the threshold amount of ambient light needed to activate the rotation timing sequence.

It is still a further object of the present invention to provide such a device which is durable, easy to manufacture, and which conserves energy by being in a deactivated state during conditions of darkness.

The present invention achieves the above objects, among others, by providing in one aspect an apparatus for supporting and rotating a hanging plant, including a housing with an upper hook fixedly attached to a top surface thereon. A lower hook extends from a bottom surface of the housing, and is for hanging and supporting a plant thereon. There is a light sensing mechanism, disposed on the outside of the housing, for detecting the amount of ambient light incident upon the housing, along with a rotary mechanism, disposed within the housing, for periodically rotating the lower hook whenever the amount of ambient light detected by the light sensing mechanism exceeds a threshold value. The rotary mechanism further includes a DC motor stationed within the housing, a reduction gearing assembly connected to an output shaft of the motor, and a vertically disposed shaft, rotatingly coupled to the reduction gearing assembly and connected to the lower hook.

In addition, a first timing mechanism, responsive to the light sensing mechanism determines when the DC motor is to be energized, while a second timing mechanism, also responsive to the light sensing mechanism, controls the duration of time that the DC motor is energized.

Preferably, the first timing mechanism includes a first timing circuit which generates a first output signal, a square wave which oscillates continuously between a high and a low voltage level. The second timing mechanism includes a second timing circuit which has an input trigger coupled to the first output signal. The input trigger causes the second timing circuit to generate a second output signal which reaches the high voltage level for a fixed length of time and then returns to the stable, low voltage level whenever the first output signal switches from the high voltage level to the low voltage level.

A driving transistor has its base terminal connected to the second output signal, and energizes the DC motor as long as the second output signal is at the high voltage level. Finally, there is an enabling circuit coupled to the first and second timing circuits, which provides a current to the first and second timing circuits and causing them to become activated whenever the current exceeds a threshold value.

These and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
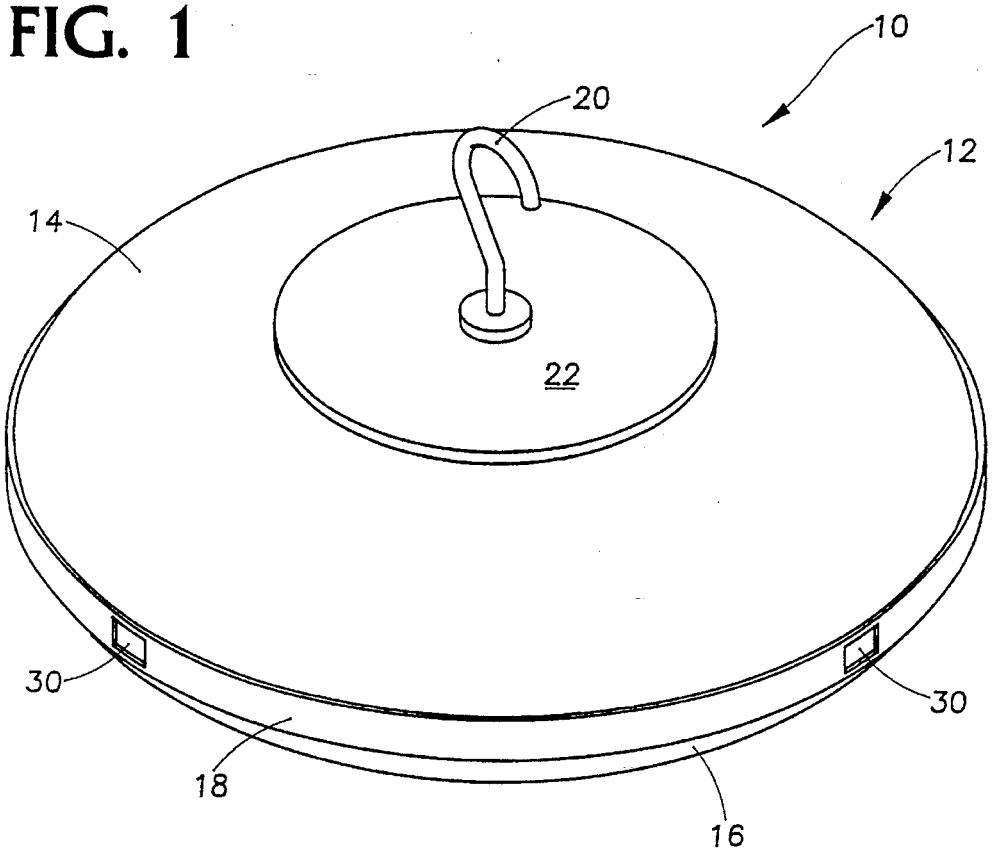
FIG. 1 is a perspective view of an apparatus for supporting and rotating a hanging plant, according to the present invention.
Figure 2:
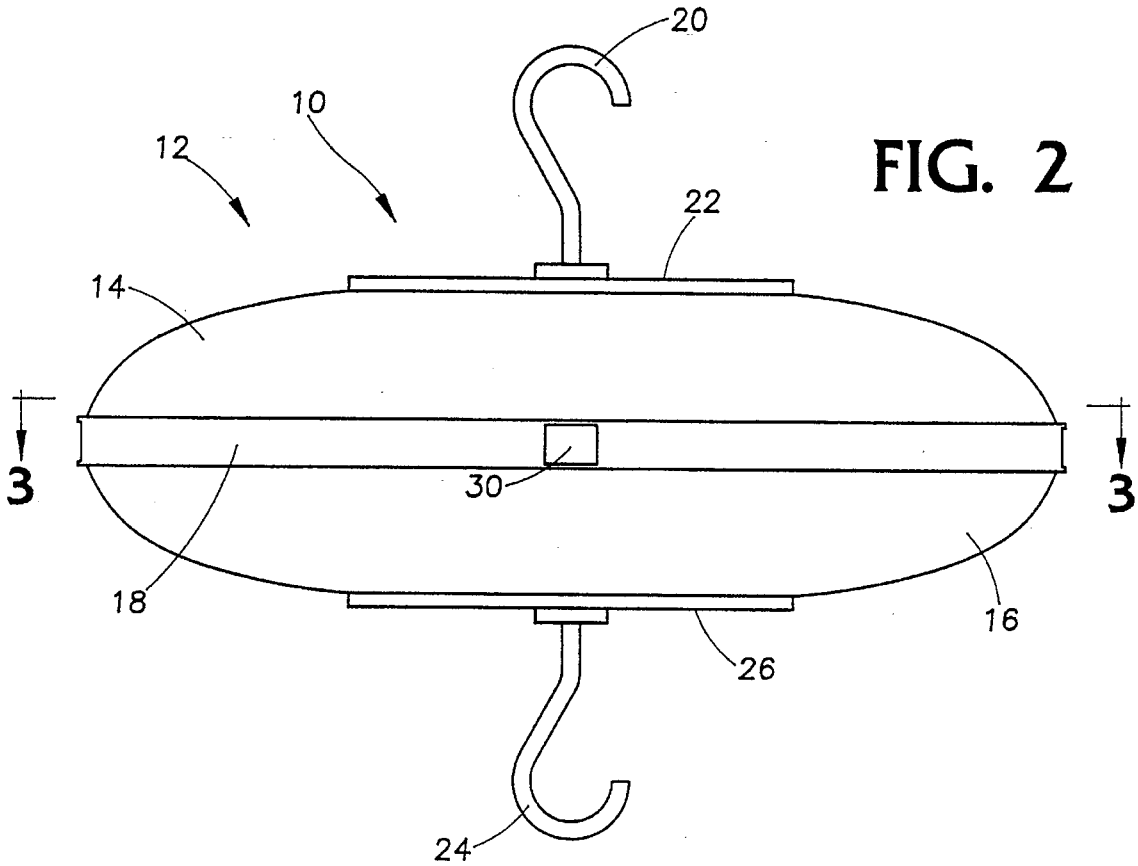
FIG. 2 is a side view of the apparatus shown in FIG. 1.
Figure 3:
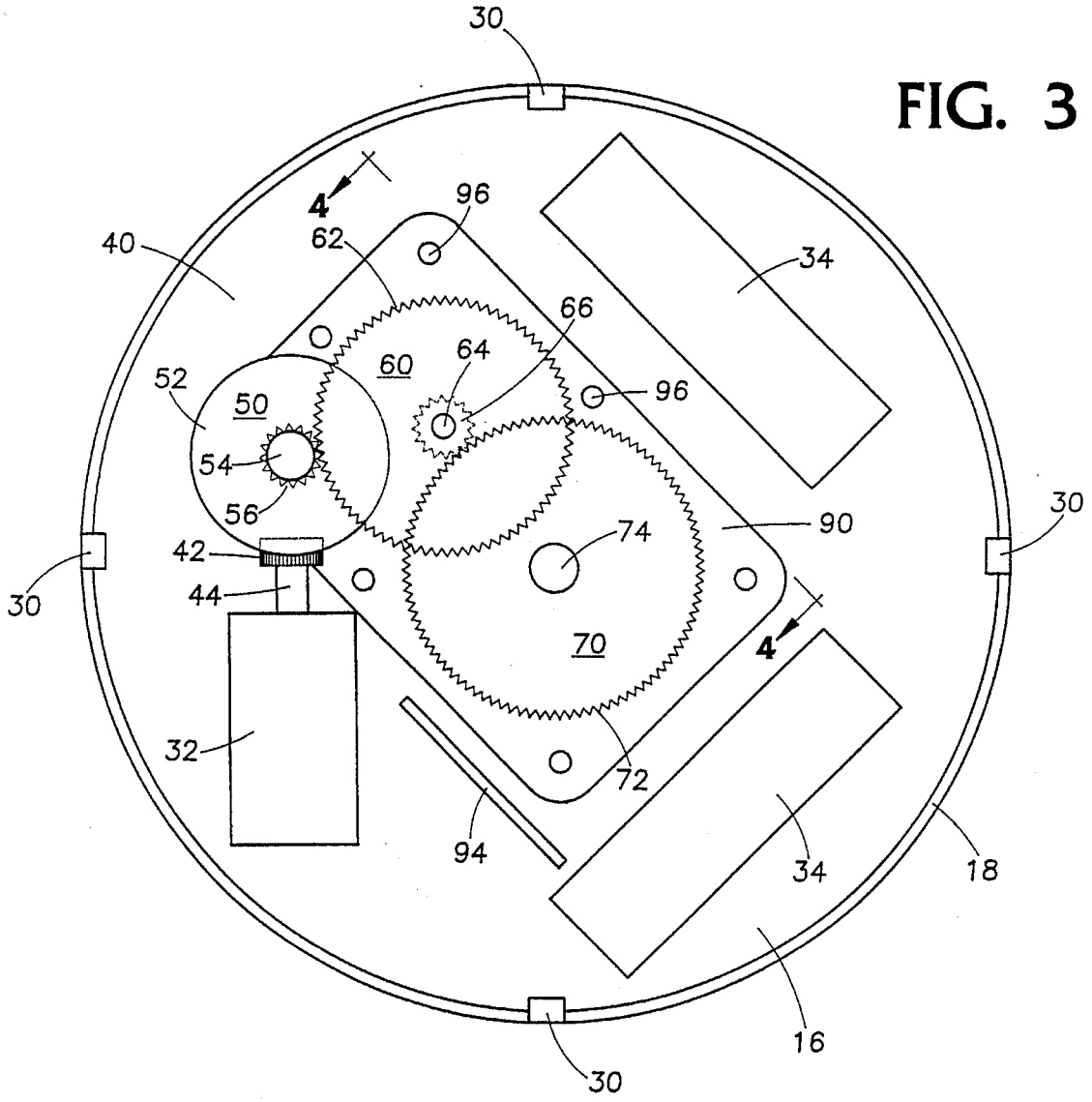
FIG. 3 is a cross sectional view, taken along lines 3—3 of FIG. 2, illustrating the internal components of the housing.

Referring initially to FIGS. 1–3, there is shown an apparatus for rotating a hanging plant, generally designated by the reference numeral 10. Apparatus 10 includes a disk shaped housing 12 having an upper half 14 and a lower half 16. The housing 12 is preferably constructed from wood, along with a brass finish ring portion 18, however plastic may be used for manufacturing simplicity. A stationary upper hook 20 is fixedly attached to the top surface 22 on the upper half 14 of the housing 12. The upper hook 20 is designed to be attached to a ceiling or other stationary surface. There is also a rotatable lower hook 24 which extends through an opening (not shown) in the bottom surface 26 of the lower half 16 of the housing 12. Positioned along the circumference of the ring portion 18 of the housing 12 are four cadmium sulfide photocells 30 for detecting the amount of ambient light present. The photocells 30, in the presence of sufficient light, initiate a rotation timing sequence for periodic rotation of the lower hook 24, the timing sequence being described in more detail hereinafter.

Figure 4:
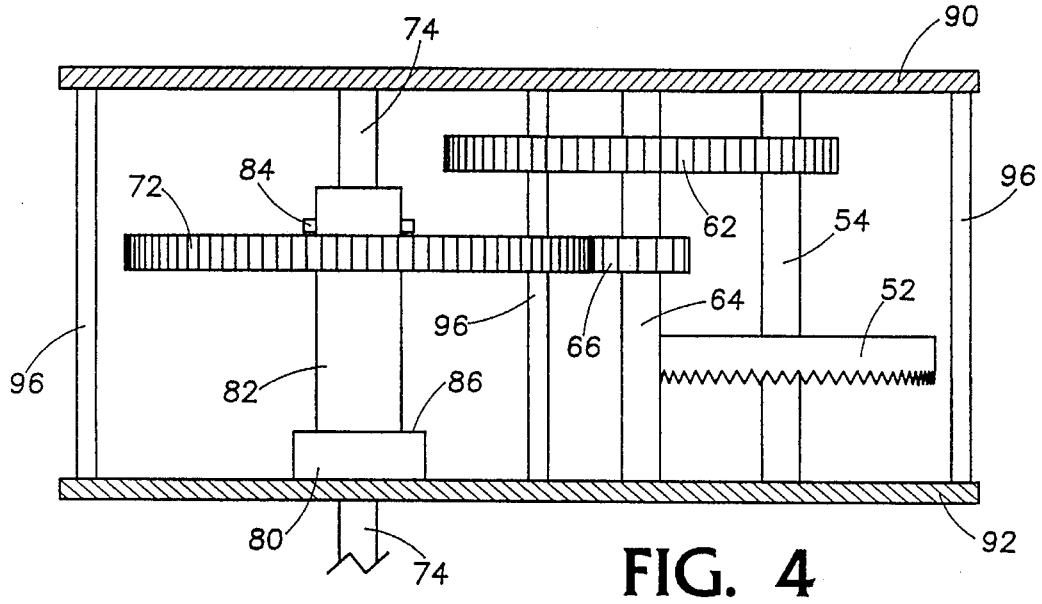
FIG. 4 is a cross sectional view, taken along lines 4—4 of FIG. 3.
Figure 5:
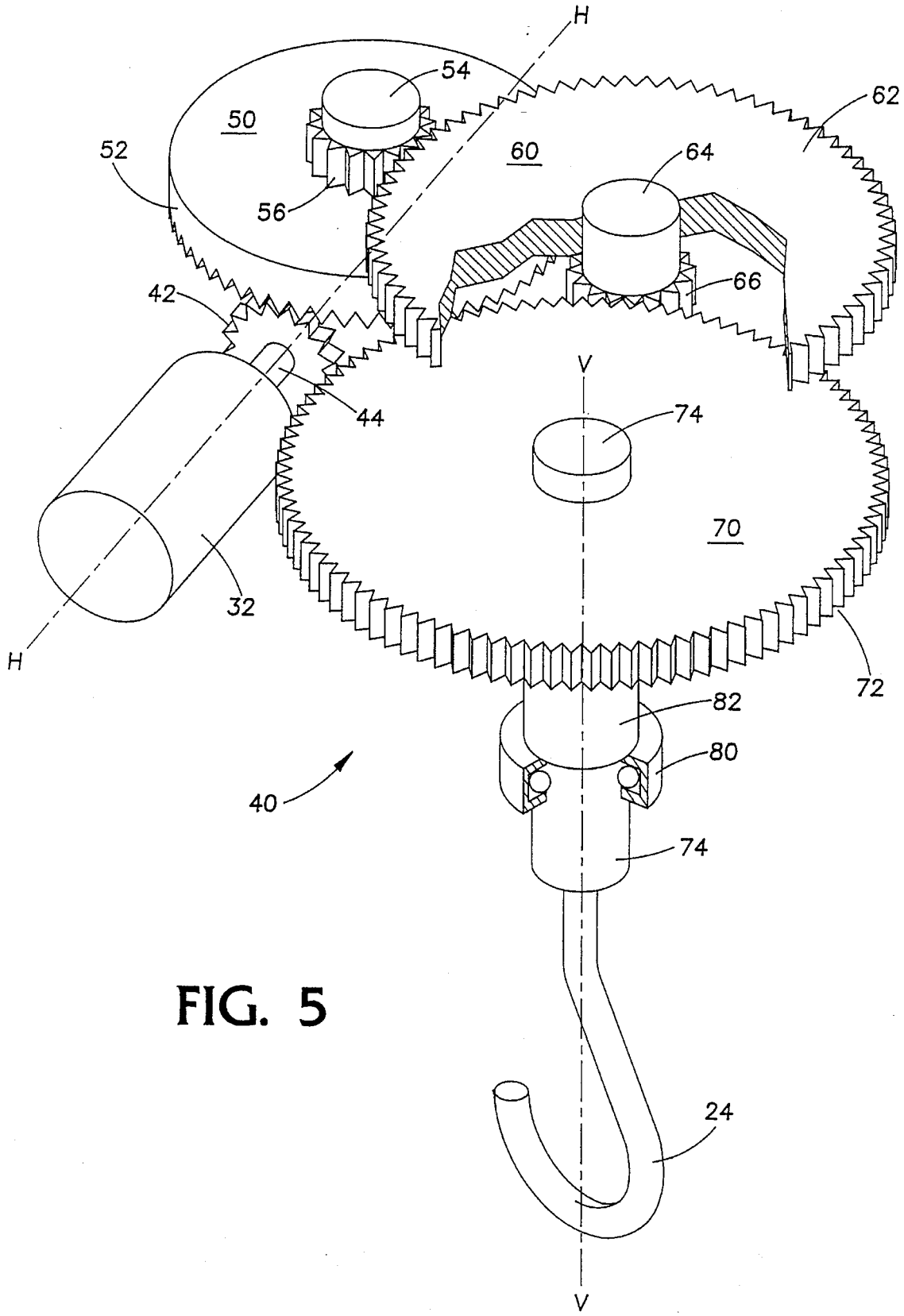
FIG. 5 is a fragmentary perspective view of the reduction gearing assembly which drives the lower hook.

FIGS. 3–5 illustrate an inside view of the lower half 16 of the housing 12, along with the associated components located therein. A 6 volt DC motor 32, is powered by four ordinary size AA batteries 34, and provides the energy necessary to rotate the lower hook 24. Both the motor 32 and the batteries 34 are mounted directly inside the lower half 16 of the housing 12. The rotational energy of the motor 32 is translated from a horizontally disposed axis H—H to a vertically disposed axis V—V (FIG. 5), and subsequently to the lower hook 24 by means of a reduction gear assembly 40. The reduction gear assembly 40 includes a pinion 42 attached to the output shaft 44 of the motor 32. The pinion 42 is meshed with a first gear and shaft combination 50, which includes gear 52 and shaft 54. Shaft 54 includes a set of teeth 56, which engages a second gear and shaft combination 60. Similarly, the second gear and shaft combination 60 includes a gear 62 and a shaft 64. Shaft 64 also has a set of teeth 66 for engagement with a third gear and shaft combination 70.

The third gear and shaft combination 70 has a gear 72 and a vertically disposed shaft 74 which is coupled to the lower hook 24. Structural support of the vertically disposed shaft 74 and associated lower hook 24 is facilitated through the use of a disk shaped bearing assembly 80. The bearing assembly 80 has a centrally located opening (not shown) to accommodate the shaft 74. A sleeve member 82, attached on the shaft 74 through a pin 84, abuts the top surface 86 of the bearing assembly 80, in order to evenly distribute the downwardly directed forces which result from the weight of an attached plant.

Finally, a pair of support platforms 90, 92 is used for mounting the motor 32, as well as the gear and shaft combinations, the bearing assembly 80, and an electronic circuit board 94. A plurality of vertical support members 96 are used as spacers for the upper 90 and lower 92 support platforms. The circuit board 94 includes the electronic circuitry necessary to execute the rotational timing sequence needed to periodically rotate the lower hook.

Figure 6:
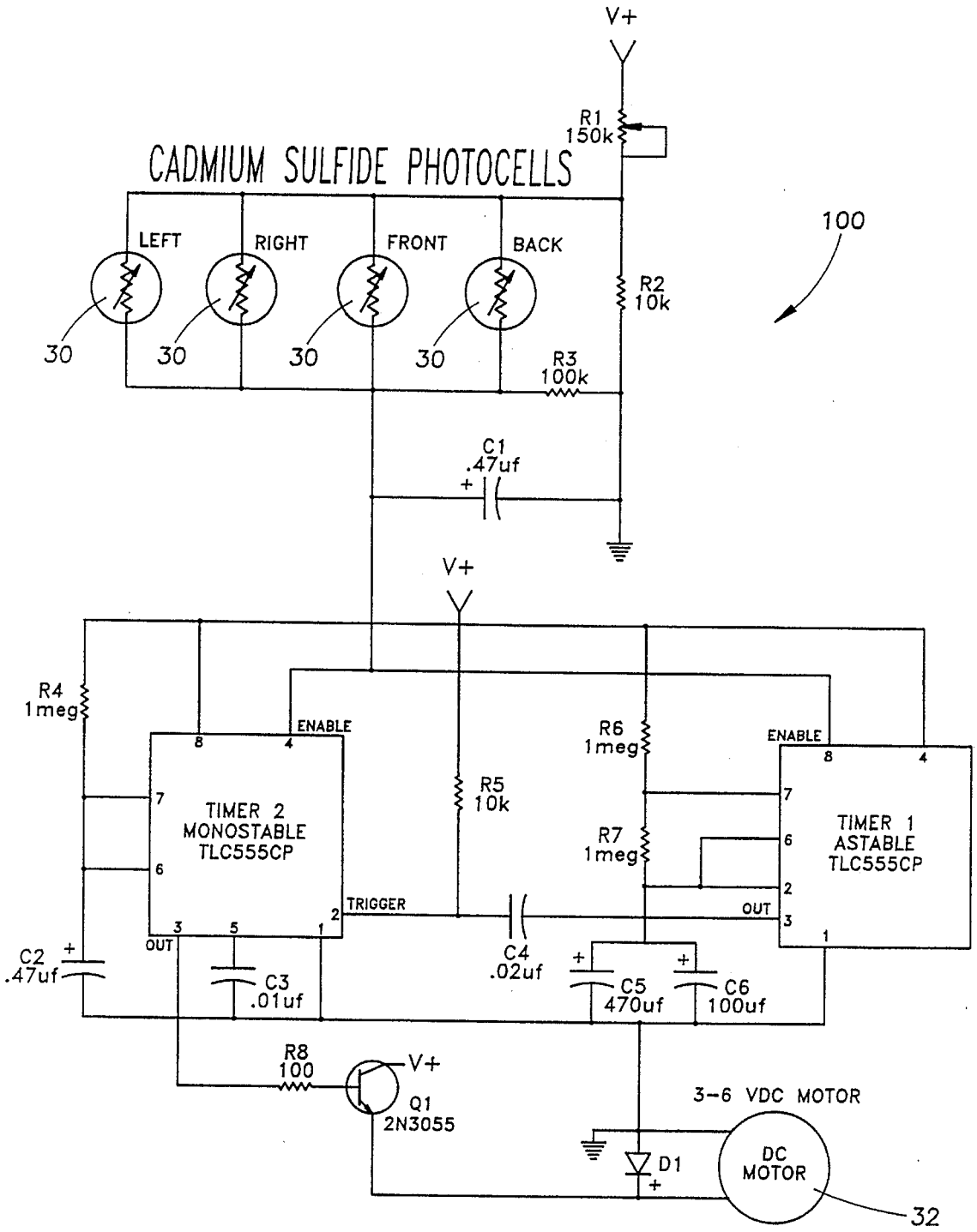
FIG. 6 is a schematic of the enabling and timing circuits.
Figure 7:
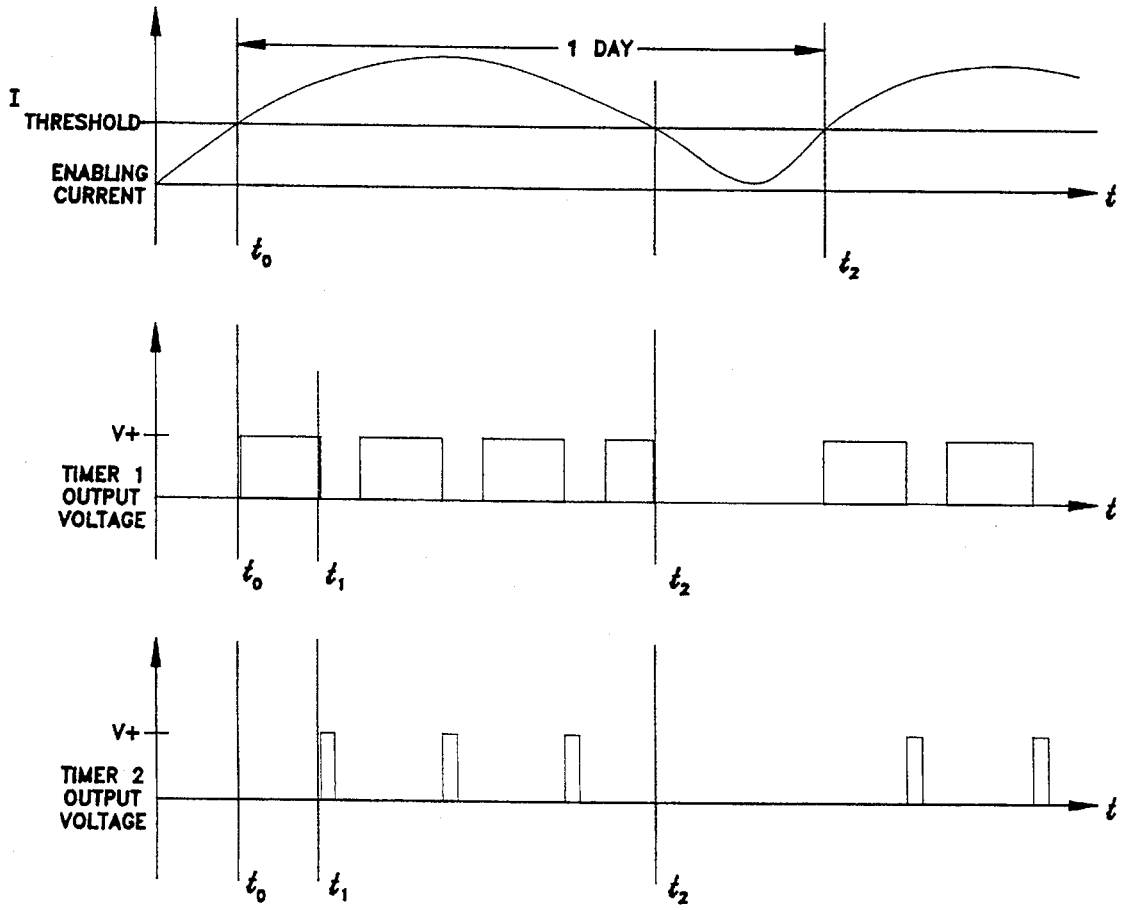
FIG. 7 is a timing diagram which illustrates the rotation timing sequence of the apparatus.

Operation of the rotation timing sequence of apparatus 10 is best understood by reference to FIGS. 6 and 7. A first 555 integrated circuit (referred to hereinafter as timer 1) is configured for use as an a stable multivibrator, or square wave generator. The input trigger (pin 2) of timer 1 is connected directly to the threshold (pin 6) in order to produce a vibrating output at pin 3. In addition, a second 555 integrated circuit (referred to hereinafter as Timer 2) is configured for use as a monostable multivibrator, or timed switch. The input trigger (pin 2) of timer 2 is coupled with the output (pin 3) of timer 1 through capacitor C4. It should be noted that both the reset pins (pin 4) of both timer 1 and timer 2 are connected to an enabling circuit, the operation of which will be described later. In most applications using 555 timers, the reset pin 4 is simply connected to the supply voltage. For purposes of the present invention, however, it is necessary to provide a control current which enables timers 1 and 2 to begin their respective timing sequences only during daylight conditions.

Whenever sufficient enabling current is present at pin 4 of timers 1 and 2, the plant rotation timing sequence commences. Initially, the output voltage of timer 1 at pin 3 is high, causing an open circuit at pin 7 and allowing capacitors C5 and C6 to be charged through resistors R6 and R7. When the voltage of capacitors C5 and C6 increases to approximately ⅔ the value of the supply voltage, timer 1 changes the output voltage at pin 3 to low. At the same time, pin 7 becomes a short to ground, thus discharging capacitors C5 and C6 through resistor R7. Once the voltage of capacitors C5 and C6 decreases to approximately ⅓ the value of the supply voltage, timer 1 will return the output voltage at pin 3 to high and reopen the internal switch at pin 7. Capacitors C5 and C6 then begin to recharge, continuing the cycle.

In contrast, the output voltage at pin 3 of timer 2 remains low in its monostable state until activated by a trigger signal at pin 2, the trigger signal being the transition of the output signal of timer 1 from high to low. Again, sufficient enabling current at pin 4 activates timer 2. Initially, the input voltage of timer 2 at pin 2 is high, being connected to V+ through resistor R5. As soon as the output voltage of timer 1 drops to low, the input voltage of timer 2 also goes to low, causing the output voltage of timer 2 to jump from low to high. This, in turn, causes the internal switch of timer 2 at pin 7 to open, allowing capacitor C2 to charge through resistor R4. As the capacitor C2 voltage at pin 6 reaches ⅔ the value of V+, the output voltage at pin 3 returns to low. Simultaneously, the internal switch at pin 7 closes and discharges capacitor C2 directly to ground. It is important to note that in order for timer 2 to provide a proper output pulse, the input trigger voltage at pin 2 must return to high before the output pulse returns to its stable state at low. Although the output of timer 1 remains at low for the negative half cycle of the square wave signal, the input signal at timer 2 will quickly return to high due to the capacitive coupling at C4. Immediately after going to ground (due to the voltage drop at pin 3 of timer 1), the input voltage at timer 2 will quickly recharge to V+ through R5 and C4. Accordingly, the values chosen for R5 and C4 must be significantly smaller than those chosen for R4 and C2, respectively, in order to allow the input signal at pin 2 to return to nigh before the output signal at pin 3 returns to low.

Finally, the output signal of timer 2 is coupled to the base terminal of transistor Q1 through resistor R8. When the output of timer 2 is pulsed high (caused by the negative leading edge of the square wave generated by timer 1), transistor Q1 is turned on, thereby energizing the DC motor 32 for the duration of time corresponding to the pulse width of the output of timer 2. The DC motor 32, protected from reverse voltage spikes by diode D1, then turns the reduction gearing assembly 40 and translates rotary motion to the shaft 74 and lower hook 24.

As mentioned earlier, the above timing sequence is activated when sufficient current is available at pin 4 of both timers. This current is supplied by an enabling circuit 100, which is also shown in FIG. 6. The enabling circuit 100 includes each of the four photocells 30 connected together in parallel and, in turn, connected in series at one end with a voltage divider comprising potentiometer R1 and resistor R2. Capacitor C1 and resistor R3 are each connected in series with the other end of the photocells 30.

In conditions of darkness, the amount of ambient light incident upon the photocells 30 is at a minimum, meaning that the electrical resistance of the photocells 30 is at a maximum. Accordingly, the resultant output current of the enabling circuit 100 is negligible, leaving timers 1 and 2 in a deactivated state. As the amount of ambient light increases, during sunrise, for example, the electrical resistance of one or more of the photocells 30 will decrease, resulting in a corresponding increase in the output current. Eventually, enough ambient light will be present to activate the timers and begin the timing sequence. Conversely, as nightfall approaches, the resistance of the photocells 30 will increase until the amount of current supplied to the timers drops below the threshold level, deactivating them until the following day. By employing the photocells 30, the life of the supply batteries 34 will be increased, since the motor 32 and timing circuitry are only operational during the day. In addition, the amount of light required to activate the timing sequence can be varied by adjusting the resistance value of potentiometer R1.

The relationship of the timing sequence of timers 1 and 2 to the amount of ambient light present on the photocells is best understood by reference to the timing diagram of FIG. 7. As the current provided by the enabling circuit 100 reaches the threshold level at $t_0$, timers 1 and 2 are activated. The output voltage of timer 1 immediately goes to V+, beginning the first positive half cycle of its square wave output. At time $t_1$, the output voltage of timer 1 returns to low, causing the output voltage of timer 2 to briefly pulse at V+, thus energizing the motor 32 and rotating the lower hook 24. The width of the output pulses of timer 2 are exaggerated for illustration purposes since, in actuality, the pulses last only for a period of approximately 1–1.5 seconds. This cycle will repeat itself until the enabling current eventually drops below the threshold level at time $t_2$, where both timers are subsequently deactivated until enough light is again present to activate them again.

It should be noted that the both the frequency and duration of the rotation of the lower hook 24 may be adjusted to by substituting different values of resistances and capacitances. With regard to timer 1, the total period T of oscillation is given by:

$$T=0.7(R6+2*R7)\ (C5+C6);$$

substituting the values shown in FIG. 6 yields a theoretical value of:

$$T=0.7(1\text{M}\Omega+2\text{M}\Omega)(470\ \mu\text{f}+100\ \mu\text{f})=1197\ \text{seconds}.$$

Experimental use, however, has shown that the actual time between output pulses of timer 2 is on the order of approximately four hours. It is believed that the relatively large values of resistances and capacitances used in conjunction with timer 1 contribute to the degree of experimental error encountered. More importantly, however, is that the desired frequency and duration of the rotation of the lower hook 24 may be adjusted to the user's specifications. During a typical day, the present invention is caused to rotate two to three times, through an angular distance of about 15 to 30 degrees for each rotation.

It will thus be seen that the objects set forth above, among those elucidated in, or made apparent from, the preceding description, are efficiently attained. Since certain changes may be made in the above construction without departing from the scope of the invention, it is intended that all matter contained in the above description or shown on the accompanying drawing shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. An apparatus for supporting and rotating a hanging plant, comprising:

a housing;

an upper hook fixedly attached to a top surface of the housing;

a lower hook, extending from a bottom surface of the housing, for hanging and supporting a plant thereon;

a light sensing means, disposed on the outside of the housing, for detecting the amount of ambient light incident upon the housing; and a rotary means, disposed within the housing, for periodically rotating the lower hook whenever the amount of ambient light detected by the light sensing means exceeds a threshold value, the rotary means further comprising:

a DC motor stationed within the housing;

a reduction gearing assembly, connected to an output shaft of the motor, comprising:

a pinion attached to the output shaft of the motor;

a first gear and shaft combination, meshed with the pinion;

a second gear and shaft combination, meshed with the first gear and shaft combination;

a third gear and shaft combination, meshed with the second gear and shaft combination; and said third gear and shaft combination including a vertically disposed shaft; and said vertically disposed shaft being rotatingly coupled to the reduction gearing assembly and connected to the lower hook; and said lower hook being capable of rotating about a longitudinal axis of the vertically disposed shaft.

2. The apparatus as described in claim 1, further comprising:

a sleeve member, surrounding a portion of the vertically disposed shaft;

a disk shaped bearing assembly having a centrally located opening to allow the vertically disposed shaft to pass therethrough; and said sleeve member abutting a top surface of the bearing assembly.

3. An apparatus for supporting and rotating a hanging plant, comprising:

a housing;

an upper hook fixedly attached to a top surface of the housing;

a lower hook, extending from a bottom surface of the housing, for hanging and supporting a plant thereon;

a light sensing means, disposed on the outside of the housing, for detecting the amount of ambient light incident upon the housing;

a rotary means, disposed within the housing, for periodically rotating the lower hook whenever the amount of ambient light detected by the light sensing means exceeds a threshold value, the rotary means further comprising:

a DC motor stationed within the housing;

a reduction gearing assembly connected to an output shaft of the motor; and a vertically disposed shaft, rotatingly coupled to the reduction gearing assembly and connected to the lower hook;

a first timing means, responsive to the light sensing means, for determining when the DC motor is to be energized;

the first timing means comprising a first timing circuit which generates a first output signal, the first output signal comprising a square wave which oscillates continuously between a high and a low voltage level; and a second timing means, also responsive to the light sensing means, for controlling the duration of time that the DC motor is energized.

4. The apparatus as described in claim 3, wherein the second timing means comprises a second timing circuit which has an input trigger coupled to the first output signal, the input trigger causing the second timing circuit to generate a second output signal which reaches the high voltage level for a fixed length of time and then returns to the stable, low voltage level whenever the first output signal switches from the high voltage level to the low voltage level.

5. The apparatus as described in claim 4, wherein:

the first timing circuit comprises a 555 integrated circuit connected in an a stable multivibrator configuration; and the second timing circuit comprises a 555 integrated circuit connected in a monostable multivibrator configuration.

6. The apparatus as described in claim 4, further comprising a driving transistor having its base terminal connected to the second output signal, the transistor energizing the DC motor as long as the second output signal is at the high voltage level.

7. The apparatus as described in claim 4, further comprising an enabling circuit coupled to the first and second timing circuits, said enabling circuit providing a current to the first and second timing circuits, causing the timing circuits to become activated whenever the current exceeds a threshold value.

8. The apparatus as described in claim 7, wherein the light sensing means comprises a plurality of cadmium sulfide photocells circumferentially positioned along the outside surface of the housing.

9. The apparatus as described in claim 8, wherein the current provided by the enabling circuit is proportional to the amount of ambient light incident upon the photocells.

10. The apparatus as described in claim 8, wherein the enabling circuit further comprises:

the plurality of photocells, each connected in parallel with one another;

a potentiometer, connected in series between a DC power source and the photocells; and said photocells having an electrical resistance which decreases linearly in proportion to the amount of ambient light incident thereon.

* * * * *